US010378825B2

(12) United States Patent
Yang et al.

(10) Patent No.: US 10,378,825 B2
(45) Date of Patent: Aug. 13, 2019

(54) HEAT EXCHANGER APPARATUS AND HEAT SOURCE UNIT

(71) Applicant: Danfoss Micro Channel Heat Exchanger (Jiaxing) Co., Ltd., Zhejiang (CN)

(72) Inventors: Jing Yang, Zhejiang (CN); Yang Xu, Zhejiang (CN); Jeffery Lee Tucker, Zhejiang (CN); Liuxiang Liu, Zhejiang (CN)

(73) Assignee: Danfoss Micro Channel Heat Exchanger (Jiaxing) Co., Ltd., Zhejiang (CN)

( * ) Notice: Subject to any disclaimer, the term of this patent is extended or adjusted under 35 U.S.C. 154(b) by 258 days.

(21) Appl. No.: 15/118,907

(22) PCT Filed: Feb. 12, 2015

(86) PCT No.: PCT/CN2015/072861
§ 371 (c)(1),
(2) Date: Aug. 15, 2016

(87) PCT Pub. No.: WO2015/120803
PCT Pub. Date: Aug. 20, 2015

(65) Prior Publication Data

US 2017/0010045 A1 Jan. 12, 2017

(30) Foreign Application Priority Data

Feb. 17, 2014 (CN) ..... 2014 1 0053051

(51) Int. Cl.
*F24F 1/14* (2011.01)
*F28D 1/04* (2006.01)
(Continued)

(52) U.S. Cl.
CPC ..... *F28D 1/0443* (2013.01); *F24F 1/14* (2013.01); *F28D 1/024* (2013.01); *F28D 1/047* (2013.01);
(Continued)

(58) Field of Classification Search
CPC ..... F28D 1/0443; F28D 1/047; F28D 1/0473; F28D 1/0475; F28D 1/0476;
(Continued)

(56) References Cited

U.S. PATENT DOCUMENTS 4,114,683 A * 9/1978 Verlinden ..... F28B 1/06 165/78
4,173,998 A * 11/1979 Jahoda ..... B21D 53/085 165/150
(Continued)

FOREIGN PATENT DOCUMENTS

CN 102472536 A 5/2012
CN 103759553 A 4/2014
(Continued)

OTHER PUBLICATIONS

Supplementary European Search Report for Serial No. EP 15 74 9695 dated Oct. 23, 2017.
(Continued)

*Primary Examiner* — Filip Zec
(74) *Attorney, Agent, or Firm* — McCormick, Paulding & Huber LLP

(57) ABSTRACT

Provided are a heat exchanger apparatus and a heat source unit that are for use in a chiller unit. The heat exchanger apparatus comprises at least one heat exchanger module (100). The heat exchanger module (100) comprises two heat exchanger units (10 and 20) that are oppositely fitted with each other. At least one between the two heat exchanger units (10 and 20) is bent so that an angle between adjacent
(Continued)

two edges (c and d) on at least one extremity of the two heat exchanger units (10 and 20) is less than an angle between main parts (12 and 22) of the two heat ex-changer units (10 and 20), thus increasing the area for heat exchange.

23 Claims, 4 Drawing Sheets

(51) Int. Cl.
*F28F 9/02* (2006.01)
*F28D 1/02* (2006.01)
*F28D 1/047* (2006.01)
*F28B 1/06* (2006.01)

(52) U.S. Cl.
CPC ..... *F28F 9/026* (2013.01); *F28B 1/06* (2013.01); *F28D 2001/0266* (2013.01); *F28D 2001/0273* (2013.01)

(58) Field of Classification Search
CPC ..... F28D 2001/0266; F28D 2001/0273; F24F 1/14; F24F 1/18; F24F 1/0059; F28F 9/026; F28F 2009/004
USPC ..... 62/285
See application file for complete search history.

(56) References Cited

U.S. PATENT DOCUMENTS 4,307,778 A * 12/1981 Tobin ..... F24F 1/18 165/125
4,475,585 A * 10/1984 Hoeffken ..... F24F 13/20 165/122
5,341,870 A * 8/1994 Hughes ..... F25B 39/02 165/110
5,632,330 A * 5/1997 Drucker ..... B60H 1/00321 165/125
2002/0134099 A1* 9/2002 Mochizuki ..... F24F 1/18 62/285
2007/0169922 A1* 7/2007 Pautler ..... F28D 1/05366 165/153
2008/0141525 A1* 6/2008 Breiding ..... B23K 1/0012 29/726.5
2009/0025409 A1* 1/2009 Kopko ..... F25B 39/04 62/186
2010/0006276 A1 1/2010 Cremaschi et al.
2011/0185574 A1* 8/2011 Samuelson ..... B21D 7/024 29/890.03
2012/0227944 A1 9/2012 Moisidis et al.
2013/0037239 A1* 2/2013 Shiborino ..... F24F 1/16 165/67
2013/0333410 A1* 12/2013 Cho ..... F24F 1/06 62/426

FOREIGN PATENT DOCUMENTS

CN 103925742 A 7/2014
EP 2461111 A1 6/2012
EP 2472111 A1 7/2012
JP 2001-21284 A 1/2001
JP 2004-340504 A 12/2004
JP 2011043128 A 3/2011
JP 4848256 B2 10/2011
WO 2009014983 A2 1/2009
WO 2011013672 A1 2/2011

OTHER PUBLICATIONS

International Search Report for PCT Serial No. PCT/CN2015/072861 dated May 6, 2015.
Notice of the Reason for Refusal with English Translation for Serial No. 2016-552300 dated Nov. 27, 2018.

* cited by examiner

HEAT EXCHANGER APPARATUS AND HEAT SOURCE UNIT

CROSS-REFERENCE TO RELATED APPLICATIONS

This application is entitled to the benefit of and incorporates by reference subject matter disclosed in the International Patent Application No. PCT/CN2015/072861 filed on Feb. 12, 2015 and Chinese Patent Application 201410053051.0 filed Feb. 17, 2014.

TECHNICAL FIELD

The present invention relates to the field of heating, ventilation and air conditioning, in particular to a heat exchange apparatus and a heat source unit for use in the technical field of commercial air conditioning.

BACKGROUND ART

The prior art document WO2011013672 has disclosed a heat source unit. Specifically, the heat source unit is provided with air heat exchangers, each air heat exchanger comprising multiple heat-dissipating fins arranged at regular intervals, heat exchange tubes passing through the heat-dissipating fins, bent plate parts which extend at two sides and are bent in the same direction, and a heat exchanger module. Each heat exchanger module comprises two air heat exchangers; each air heat exchanger has a bent part disposed opposite a bent part of another air heat exchanger. The air heat exchanger is inclined, such that bottom edges are close to each other but top edges are spaced apart; thus the heat exchanger module is substantially V-shaped in a side view drawing.

However, edges of heat exchangers at left and right sides in the heat source unit are spaced apart in an upper part of the V-shaped structure. Thus, a shrouding plate (or metal plate) is still needed to connect two heat exchangers, and as a result, the space between two heat exchangers is not effectively used.

In view of the above, there is definitely a need to provide a novel heat exchange apparatus and a heat source unit which are capable of at least partially solving the above problem.

SUMMARY

The object of the present invention is to resolve at least one aspect of the abovementioned problems and shortcomings in the prior art.

According to one aspect of the present invention, a heat exchange apparatus for a water chiller unit is provided, the heat exchanger module comprising two heat exchange units fitted together facing each other, at least one of the two heat exchange units being bent such that an included angle between two edges of the two heat exchange units, which edges are adjacent at least at one end, is smaller than an included angle between main body parts of the two heat exchange units.

Specifically, the included angle between two edges of the two heat exchange units, which edges are adjacent at least at one end, is in the range of 0° to 15°.

Specifically, the minimum separation between the two adjacent edges is in the range of 0-100 mm.

Specifically, one of the two heat exchange units is the bent heat exchanger and the other is a flat-plate heat exchanger which has not been bent.

Specifically, the bent heat exchanger has a main body part, and a front part and a rear part connected to the main body part, wherein the front/rear parts are formed by bending a flat-plate heat exchanger along a bending axis.

Specifically, the front/rear parts extend outwards from respective main body parts, and an included angle between the front/rear part and the main body part is in the angular range of 0 to 90°.

Specifically, an included angle between the bending axis and a top edge or bottom edge of the front part or rear part of the bent heat exchanger is an acute angle.

Specifically, the two adjacent edges are parallel or substantially parallel.

Specifically, the shapes of the two heat exchange units are the same or symmetrical.

Specifically, the two heat exchange units are rectangular heat exchangers before bending.

Specifically, an included angle between each of the heat exchangers and a horizontal plane differs from an included angle between a bending axis and a top surface of the heat exchanger by 0° to 10°.

Specifically, by having a bending radius gradually increasing from the bottom to the top of the heat exchanger along the bending axis, the main body part of the heat exchanger is made to be rectangular or substantially rectangular, and the front/rear parts are substantially perpendicular or perpendicular to a horizontal plane.

Specifically, the two heat exchange units are trapezoidal heat exchangers before bending.

Specifically, the two heat exchange units are isosceles trapezoidal heat exchangers before bending.

Specifically, a bending axis is perpendicular or substantially perpendicular to top and bottom bases of a trapezoid, and a top apex angle of the trapezoid differs from an included angle formed by the heat exchanger and a horizontal plane by 0° to 10°.

Specifically, the two heat exchange units have different sizes, and the two heat exchange units before bending are both isosceles trapezoidal heat exchangers;

one of the two heat exchange units is bent so as to form a main body part and front/rear parts connected to the main body part; the other is not bent and the size thereof is configured to enable it to mate between the front and rear parts, such that an included angle between a side edge of the front part or rear part of the bent heat exchanger and a side edge of the heat exchanger which is not bent is in the range of 0-15°.

Specifically, an included angle between the bending axis and a top surface of a bent heat exchanger, and a top apex angle of the bent heat exchanger, differ from an included angle between the bent heat exchanger and a horizontal plane by 0-10°.

Specifically, an included angle between the bending axis and a top surface of a bent heat exchanger, and a top apex angle of the bent heat exchanger, are equal or approximately equal to an included angle between the bent heat exchanger and a horizontal plane.

In another aspect of the present invention, a heat exchange apparatus for a water chiller unit is provided, the heat exchange apparatus comprising at least one heat exchanger module. The heat exchanger module comprises a heat exchange unit and a supporting member fitted together facing each other, the heat exchange unit being bent such that an included angle between two edges of the heat exchange unit and supporting member, which edges are adjacent at least at one end, is smaller than an included angle between the heat exchange unit and supporting member.

Specifically, the included angle between the two edges which are adjacent at least at one end is in the range of 0° to 15°.

Specifically, the supporting member is a metal plate, and the minimum separation between two adjacent edges of the supporting member and heat exchange unit is in the range of 0-100 mm.

In another aspect of the present invention, a heat source unit is provided, the heat source unit also comprising, in cooperation with each other, a heat exchange apparatus, a blower, a water drainage plate in communication with a heat exchanger apparatus, and a machine room which houses cooling cycle constituent parts other than the heat exchange apparatus. The heat exchange apparatus is a heat exchange apparatus in accordance with the above description.

The heat exchange apparatus according to the present invention has no need for additional sheet metal to connect the left/right-side heat exchangers. At least one of the left/right-side heat exchangers is bent, and the left/right-side heat exchangers are connected to each other to increase the heat exchange area.

BRIEF DESCRIPTION OF THE DRAWINGS

These and/or other aspects and advantages of the present invention will become obvious and easy to understand through the following description of the preferred embodiments in conjunction with the accompanying drawings, wherein.

DETAILED DESCRIPTION

The technical solution of the present invention is explained in further detail below by means of embodiments, in conjunction with FIGS. 1-7. In this description, identical or similar drawing labels indicate identical or similar components. The following explanation of the embodiments of the present invention with reference to the accompanying drawings is intended to explain the overall inventive concept of the present invention, and should not be interpreted as a limitation of the present invention.

As will be understood from the background art of the present invention, the key design point of the present invention lies in improvement of the heat exchanger module used in the heat source unit in the document WO 2011013672. Specifically, since the pair of heat exchangers in that document are arranged in a substantially V-shaped form in a side view drawing, a substantially V-shaped space will be formed between opposing bent parts of opposing air heat exchangers. Clearly, in the above document, the space between main body parts between the pair of heat exchangers that have been fitted together, and the space between their adjacent bent parts, both substantially form the same V-shape, in other words the included angles between them are the same, and are generally in the range of 60-90°. The final result is that the V-shaped space between the pair of heat exchangers is not used effectively. Since the included angle between them is large, the V-shaped space must be closed by a plate body that has been cut into a substantially V-shaped form, i.e. a shrouding plate, to prevent wind from passing through the V-shaped space and affecting the heat exchange effect.

In the present invention, a heat exchange apparatus is provided, which successfully resolves the shortcomings mentioned in the above document. Thus, the description below will focus on ways in which the present invention improves the heat exchange apparatus. The arrangement of components in the heat source unit (such as a blower, a water drainage plate in communication with the heat exchange apparatus, and a machine room which houses cooling cycle constituent parts other than the heat exchange apparatus) may also be applied in the present invention, and therefore the aforesaid document may be referred to for a specific description of those components, which are not described in detail again here.

The heat exchange apparatus according to an embodiment of the present invention may be applied to a commercial air conditioning system, specifically used in a heat source unit or a water chiller unit. In general, the heat exchange apparatus comprises at least one heat exchanger module, each heat exchanger module comprising a pair of opposing heat exchangers. Only one heat exchanger module comprising two opposing heat exchangers is shown hereinbelow as an example, for the sake of conciseness.

Figure 1:
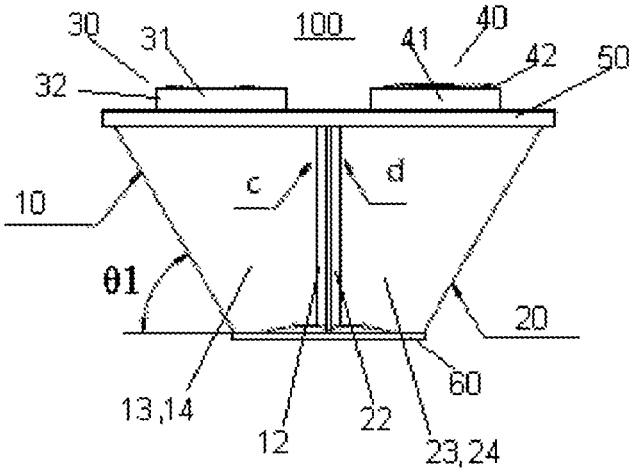
FIG. 1 is a schematic diagram of a heat exchanger module according to a first embodiment of the present invention.

FIG. 1 merely shows a view of a heat exchange apparatus, omitting the related components in a water chiller unit or heat source unit associated therewith. In view of the fact that the main design of the present invention relates to the heat exchange apparatus, such an omission will not affect the understanding of the present invention by those skilled in the art, and will not result in the disclosed content of the present invention being incomplete.

As FIG. 1 shows, the heat exchanger module 100 comprises two heat exchangers 10 and 20, which are fitted together facing each other and located on the left and right sides of the heat exchanger module. It can be understood that the heat exchange apparatus according to the present invention may comprise multiple (e.g. 4) heat exchanger modules 100 and a corresponding number of blower modules or blower units, wherein the multiple blower modules or blower units form a blower apparatus or blower system. Of course, each blower unit or module may also be one blower or a greater number of blowers.

Specifically, a top end of the heat exchanger module 100 is provided with a top plate 50, and blower modules or units 30 and 40 are provided on the top plate in a position corresponding to the heat exchangers 10 and 20. In one embodiment, cylindrical wind outlets 31 and 41 are provided in a direction of upward protrusion from the top plate 50, and fan shrouds 32 and 42 cover protruding end faces of the wind outlets 31 and 41. The blowers 30 and 40 comprise: propeller-type fans, accommodated in the wind outlets 31 and 41; shaft cores, mounted in opposition to the fan shrouds 32 and 42, and fan motors, with the propeller-type fans being mounted on rotation shafts.

Of course, in order to fix the heat exchanger module 100 in place better, the bottom of the heat exchanger module 100 may also be provided with a supporting element or supporting frame 60 which fixes it in place.

Specifically, the heat exchanger module 100 comprises at least two heat exchangers 10 and 20, which are fitted together facing each other and located on the left and right sides; the example of two heat exchangers is used here. In the present invention, an included angle between two edges (e.g. edges c and d mentioned below) of the two heat exchangers 10 and 20, which edges are adjacent at least at one end (e.g. a front end or rear end in the plane of the drawing), is set to be smaller than an included angle between main body parts (e.g. the main body parts 12 and 22 mentioned below) of the two heat exchangers 10 and 20, to increase the heat exchange area.

The included angle between a right edge c of the left-side heat exchanger 10 and a left edge d of the right-side heat exchanger 20 (i.e. two adjacent edges c and d) is in the range of 0° to 15°. Clearly, the left edge d and the right edge c may be located on the front end or rear end in the plane of the drawing, and of course, the included angle between two edges which are adjacent on the front end and rear end can at the same time be set to be less than 15°. In addition, the size of the included angle between them can be set specifically as required by those skilled in the art. Preferably, the right edge c and the left edge d are tending to be parallel, are parallel, or have no obvious included angle, so as to make effective use of the space to increase the heat exchange area, and improve the heat exchange performance. In general, it is desired that the minimum separation between the edges c and d is in the range of 0-100 mm. For example, in the case where the tops of the heat exchangers are separated from one another, the minimum separation or distance between them at the bottom is in the range of 1-100 mm, and may be specifically set as required.

In addition, it can be understood that it is possible that only one of the heat exchangers is bent, e.g. the heat exchanger 10, and the other heat exchanger or the right-side heat exchanger may be replaced by a metal plate or a non-bent heat exchanger.

Of course, in the case where two adjacent edges of two heat exchangers are arranged as described above (e.g. when they are parallel or substantially parallel, forming an angle smaller than 15°, in particular when the two heat exchangers are in contact with one another), there is no need to provide a shrouding plate as in the document WO 2011013672.

Figure 3:
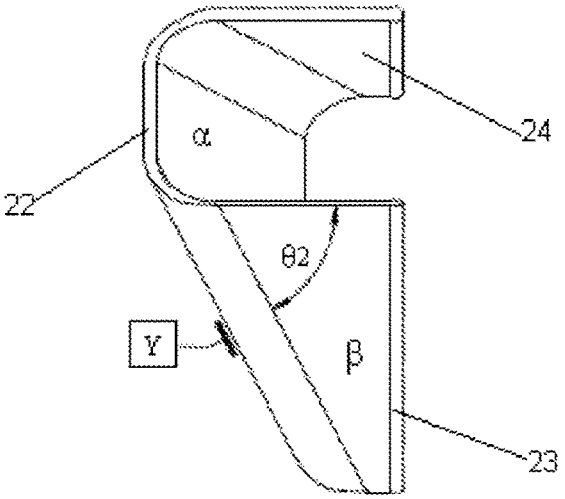
FIG. 3 is a schematic diagram of the heat exchanger in FIG. 2 after being bent.

Referring to FIG. 3, in this embodiment, each of the heat exchangers 10 and 20 is bent so as to have a main body part 12, 22 as well as a front part 13, 23 and a rear part 14, 24 connected to the main body part thereof. It can be understood that a heat exchanger could also be processed into the form described for the heat exchangers 10 and 20 of the present invention by integral forming or another similar process.

In the case of each or both of the heat exchangers 10 and 20 in the present invention, the front/rear parts 13, 14 and 23, 24 can be formed by bending a heat exchanger from the prior art, for example in the form of a flat plate, along a bending axis [y] that is preset on the heat exchanger.

It can be seen from FIG. 3 that the front/rear parts 13, 14, 23 and 24 extend outwards from respective main body parts 12 and 22, and the included angle between the front/rear part and the main body part is in the angular range of 0 to 90°.

Clearly, in an embodiment of the present invention, the included angle between adjacent edges c and d is smaller than the included angle between the main body parts 12 and 22 of the heat exchangers 10 and 20. Through the use of such a structural arrangement, the heat exchange area can be increased relative to the heat exchanger in the abovementioned document. All of the heat exchanger modules mentioned in the embodiments of the present invention below have the abovementioned structural characteristic, which is not repeated here.

Three embodiments of the present invention are shown in FIGS. 2-7 below, and relate how to form the heat exchangers needed for the heat exchanger module 100 shown in the present invention by bending heat exchangers of different types. It should be understood that when a heat exchange device is formed by arranging multiple heat exchanger modules side by side, heat exchanger modules 100 according to the present invention may be used for just a part thereof, or at least at the two outermost sides of the heat exchange device. Although, in a preferred embodiment, the heat exchange device is formed entirely from heat exchanger modules 100 according to the present invention, and this is not necessary.

Figure 2:
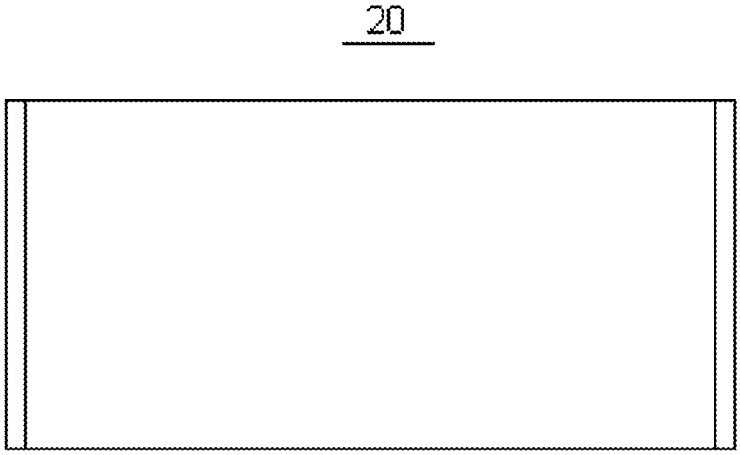
FIG. 2 is a schematic diagram of a heat exchanger of the heat exchange apparatus shown in FIG. 1 before being bent.

FIGS. 2 and 3 show examples of heat exchangers which may be used as the heat exchanger module 100 as shown in FIG. 1. Specifically, FIG. 2 shows a substantially rectangular heat exchanger in the form of a plate for the heat exchanger 10 or 20 before being bent. Although not specifically shown, it can be clearly understood that components, such as inlet/outlet manifolds, flat tubes therebetween and fins, may be disposed in the rectangular heat exchanger in the form of a plate.

It must be explained here that since the left-side heat exchanger 10 and right-side heat exchanger 20 are arranged to have the same shape or be symmetric, only one of these heat exchangers, e.g. the right-side heat exchanger 20, is taken as an example to explain how the bending is carried out; by the same principle, the left-side heat exchanger 10 can be bent in the same way. By means of bending, the right edge c and left edge d of the left/right-side heat exchangers 10 and 20 can be made to be parallel, tending to be parallel, or having no obvious included angle, as shown in FIG. 1. Here, the meaning of no obvious included angle is merely that the included angle between the right edge c and the left edge d is in the range of 0 to 15°.

FIG. 3 shows the right-side heat exchanger 20 after bending. In FIG. 3, the rectangular heat exchanger is bent along bending axes [y] on two sides thereof, such that the right-side heat exchanger 20 has a main body part 22 and front/rear parts 23 and 24. α is a left side face of (the main body part of) the right-side heat exchanger 20; β is a front or rear side face of (the front/rear part of) the right-side heat exchanger 20.

Referring to FIG. 1, the included angle that the heat exchangers 10 and 20 on the left and right sides form with a horizontal plane is 81; the included angle between the bending axis [y] and a top plane of the right-side heat exchanger 20 is θ2. The angles θ1 and θ2 are equal or approximately equal. Clearly, the difference between the angles θ1 and θ2 is preferably in the range of 0°-10°, such that the right edge c and left edge d of the left/right-side heat exchangers 10 and 20 are perpendicular to or tending to be perpendicular to a horizontal plane (not marked). In general, the angle θ2 is an acute angle.

It can be understood that when bending is carried out, the bending radii may be the same. Of course, it is also possible for the bending radius to gradually increase from the bottom to the top along the bending axis [y], such that the left side face a of the main body part 22 tends to be rectangular, and the front/rear side faces 13 of the front/rear parts 23 and 24 tend to be perpendicular to a horizontal plane.

Figure 4:
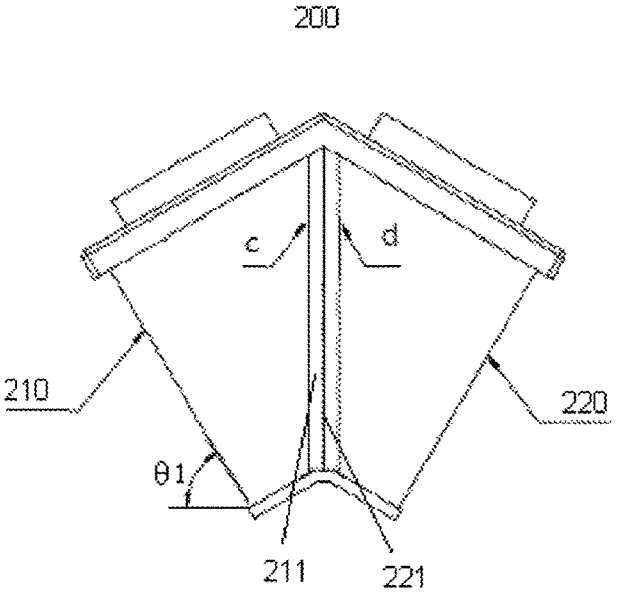
FIG. 4 is a schematic diagram of a heat exchanger module according to a second embodiment of the present invention.

Refer to FIG. 4, which shows a heat exchanger module 200 according to a second embodiment of the present invention. It can be seen from FIG. 4 that the right edge c and left edge d of main body parts 221 and 221 of the heat exchangers 210 and 220 on the left and right sides are arranged so as to be parallel, tending to be parallel, or having no obvious included angle. As stated above, the meaning of "no obvious included angle" here is still that the included angle between the right edge c and the left edge d is in the range of 0 to 15°. When the heat exchangers 210 and 220 on the left and right sides are fitted together, since their top surfaces are inclined, a fan mounted thereon also forms a certain included angle with a horizontal plane.

Figure 5:
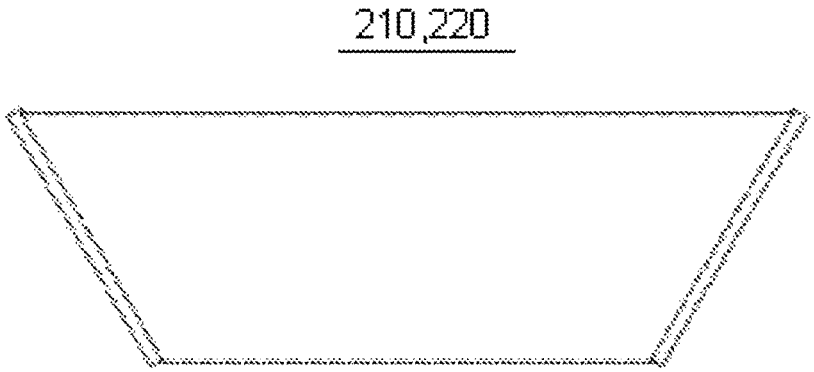
FIG. 5 is a schematic diagram of the heat exchanger of FIG. 4 before being bent.

Specifically, referring to FIG. 5, the heat exchangers 210 and 220 on the left and right sides are arranged to have the same shape or to be symmetrical with respect to each other. However, before bending, the heat exchangers 210 and 220 on the left and right sides are both trapezoidal heat exchangers in the form of a plate. Here, the choice of a trapezoidal heat exchanger is merely an example.

Figure 6:
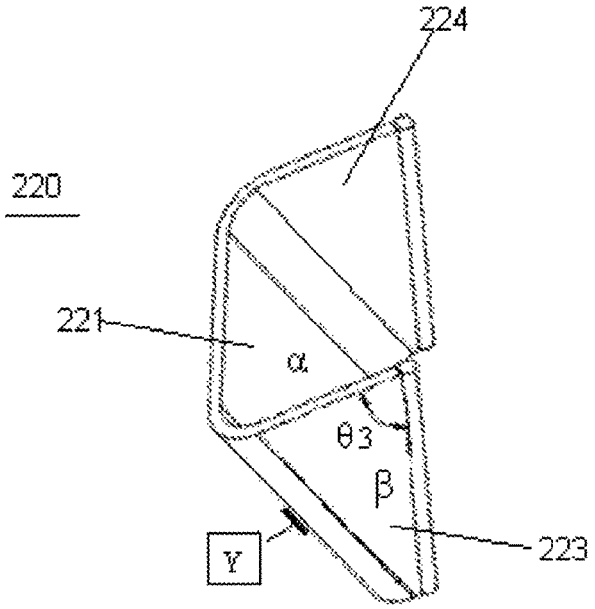
FIG. 6 is a schematic diagram of the heat exchanger of FIG. 4 after bending.

Referring to FIG. 6, as stated above, since the two heat exchangers have exactly the same structure, and are bent in the same way, a detailed explanation of how just one of them is bent is provided here. Here, the bending axis [y] is perpendicular to or tending to be perpendicular to top and bottom edges of the trapezoid, and an apex angle of the trapezoid is θ3 (generally an acute angle), wherein θ3 is equal to or approximately equal to the included angle θ1 which the heat exchangers 210 and 220 on the left and right sides form with a horizontal plane (see FIG. 4), and a preferred solution is that the difference between their angles is in the range of 0°-10°, such that the right and left edges c and d of the left/right-side heat exchangers after bending are parallel or tending to be parallel or having no obvious included angle. After bending, two sides of the main body part 221 of the right-side heat exchanger are provided with front/rear parts 223 and 224 which extend outwards therefrom at a certain angle. α is a left side face of (the main body part of) the right-side heat exchanger 220; β is a front or rear side face of (the front/rear part of) the right-side heat exchanger 220.

Figure 7:
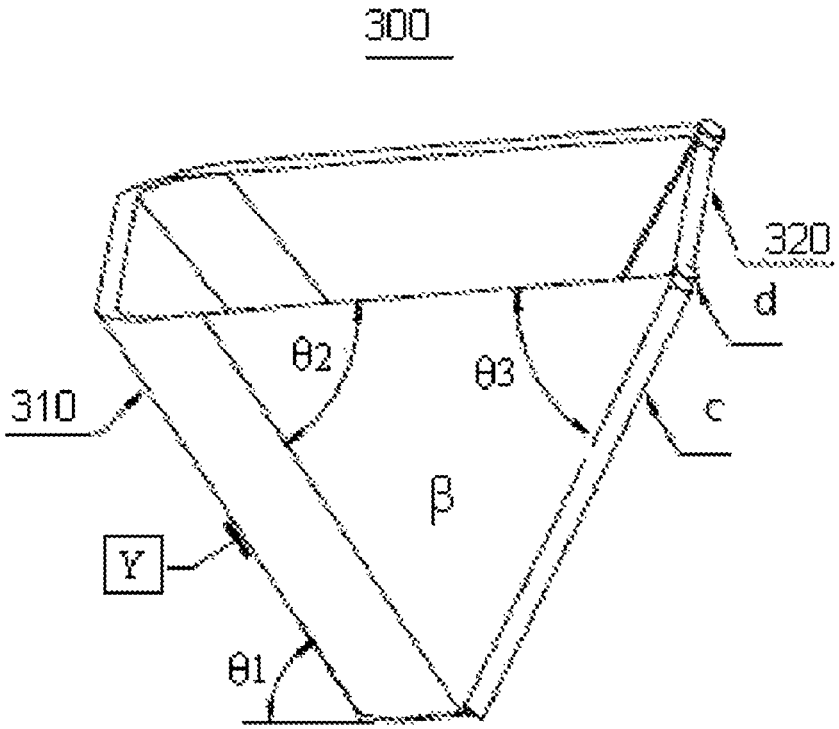
FIG. 7 is a schematic diagram of a heat exchanger module according to a third embodiment of the present invention.

Refer to FIG. 7, which shows a heat exchanger module 300 according to a third embodiment of the present invention. The heat exchanger module 300 also comprises heat exchangers 310 and 320 on the left and right sides which are fitted together. However, these differ from the heat exchanger modules in the first and second embodiments, in that only one of the heat exchangers is bent (the left-side heat exchanger 310 in this example); the right-side heat exchanger 320 is not bent, but is directly mounted in the bent left-side heat exchanger 310. Of course, in general, the heat exchangers 310 and 320 on the left and right sides are of different sizes. If possible, the sizes of the heat exchangers 310 and 320 on the left and right sides may also be set to be the same.

The sizes of the left/right-side heat exchangers 310 and 320 are set to be different hereinbelow, but the left-side heat exchanger 310 and right-side heat exchanger 320 are both isosceles trapezoids before bending. The left-side heat exchanger 310 is then bent, but the right-side heat exchanger 320 is not bent. An outermost edge or right edge c of a front/rear side face 13 of (the front/rear side part of) the bent left-side heat exchanger 310, and a side edge d of the right-side heat exchanger 320 are configured to be parallel, tending to be parallel, or having no obvious included angle. It must be explained that the meaning of no obvious included angle is that the included angle between the edges c and d is in the range of 0 to 15°, such that the top plane of the assembled heat exchanger module 300 is horizontal or approximately horizontal.

Specifically, an apex angle of the left-side heat exchanger 310 is θ3 (generally an acute angle), the included angle between a bending axis [y] of the left-side heat exchanger and a top surface of the left-side heat exchanger is θ2, and the included angle between a left side of the left-side heat exchanger 310 and a horizontal plane is θ1. Specifically, angles θ3 and θ2 are equal to or approximately equal to θ1, or differ by 0°-10°.

In summary, in the present invention, the included angle between the bending axis and a top edge or bottom edge of the front part or rear part of the heat exchanger after bending is an acute angle.

In the same heat source unit, the heat exchange apparatus of the present invention can improve performance and efficiency. If the same heat exchanger performance is required, then the heat exchange apparatus of the present invention can reduce the number of heat source units, for the purpose of reducing costs.

The above are merely some embodiments of the present invention. Those skilled in the art will understand that changes may be made to these embodiments without departing from the principles and spirit of the overall inventive concept. The scope of the present invention shall be defined by the claims and their equivalents.

What is claimed is:

1. A heat exchange apparatus for a water chiller unit, the heat exchange apparatus comprising at least one heat exchanger module, wherein:

the heat exchanger module comprises two heat exchange units fitted together facing each other with a first plane therebetween, at least one of the two heat exchange units being bent such that an included angle between two edges of the two heat exchange units, which edges are adjacent at least at one end, is smaller than an included angle between main body parts of the two heat exchange units;

wherein the two heat exchange units have a bottom portion at a second plane and a top portion at a third plane, the second plane and the third plane being perpendicular to the first plane;

wherein the two heat exchange units define a first area at the second plane and a second area at the third plane, the first area being smaller than the second area;

wherein the included angle between the two edges of the two heat exchange units and the included angle between the main body parts of the two heat exchange units span in a direction perpendicular to the first plane and extend between the second plane and the third plane.

2. The heat exchange apparatus as claimed in claim 1, wherein: the included angle between two edges of the two heat exchange units, which edges are adjacent at least at one end, is in a range of 0° to 15°.

3. The heat exchange apparatus as claimed in claim 1, wherein: a minimum separation between the two adjacent edges is in a range of 0-100 mm.

4. The heat exchange apparatus as claimed in claim 1, wherein: the at least one of the two heat exchange units is a bent heat exchanger and a second heat exchange unit of the two heat exchange units is a flat-plate heat exchanger which has not been bent.

5. The heat exchange apparatus as claimed in claim 1, wherein: the at least one of the two heat exchange units is a bent heat exchanger having a first main body part of the main body parts, and a front part and a rear part connected to the first main body part, wherein the front part and the rear part are formed by bending a flat-plate heat exchanger along a bending axis.

6. The heat exchange apparatus as claimed in claim 5, wherein: the front part and the rear part extend outwards from the first main body part, and an included angle between the front part and the first main body part is in the angular range of 0 to 90° and an included angle between the rear part and the first main body part is in an angular range of 0° to 90°.

7. The heat exchange apparatus as claimed in claim 5, wherein: an included angle between the bending axis and a top edge or bottom edge of the front part or rear part of the bent heat exchanger is an acute angle.

8. The heat exchange apparatus as claimed in claim 2, wherein: the two adjacent edges are parallel.

9. The heat exchange apparatus as claimed in claim 1, wherein: a shape of one of the two heat exchange units and a shape of a second of the two heat exchange units are the same or symmetrical.

10. The heat exchange apparatus as claimed in claim 9, wherein: the two heat exchange units are rectangular heat exchangers in an unbent state.

11. The heat exchange apparatus as claimed in claim 10, wherein: an included angle between each of the two heat exchange units and the second plane differs from an included angle between a bending axis and a top surface of the heat exchanger by 0° to 10°.

12. The heat exchange apparatus as claimed in claim 11, wherein: by having a bending radius gradually increasing from the bottom to the top of heat exchange unit along a bending axis, the main body parts of the heat exchange units are made to be rectangular, and a front part and a rear part of each heat exchange unit are perpendicular to the second plane.

13. The heat exchange apparatus as claimed in claim 9, wherein: the two heat exchange units are trapezoidal heat exchangers in an unbent state.

14. The heat exchange apparatus as claimed in claim 13, wherein: the two heat exchange units are isosceles trapezoidal heat exchangers in an unbent state.

15. The heat exchange apparatus as claimed in claim 14, wherein: a bending axis is perpendicular to top and bottom bases of a trapezoid, and a top apex angle of the trapezoid differs from an included angle formed by the heat exchanger and the second plane by 0° to 10°.

16. The heat exchange apparatus as claimed in claim 1, wherein:

the two heat exchange units have different sizes, and the two heat exchange units are both isosceles trapezoidal heat exchangers in an unbent state;

one of the two heat exchange units is a bent heat exchanger so as to form a first main body part and a front part and a rear part are connected to the first main body part; a second heat exchange unit of the two heat exchange units is not bent and the size thereof is configured to enable it to mate between the front part and the rear part, such that an included angle between a side edge of the front part or the rear part of the bent heat exchanger and a side edge of the heat exchanger which is not bent is in the range of 0-15°.

17. The heat exchange apparatus as claimed in claim 16, wherein: an included angle between a bending axis and a top surface of a bent heat exchanger, and a top apex angle of the bent heat exchanger, differ from an included angle between the bent heat exchanger and the second plane by 0-10°.

18. The heat exchange apparatus as claimed in claim 17, wherein: an included angle between the bending axis and a top surface of a bent heat exchanger, and a top apex angle of the bent heat exchanger, are equal to an included angle between the bent heat exchanger and the second plane.

19. A heat exchange apparatus for a water chiller unit, the heat exchange apparatus comprising at least one heat exchanger module, wherein:

the heat exchanger module comprises a heat exchange unit and a supporting member fitted together facing each other, the heat exchange unit being bent such that an included angle between two edges of the heat exchange unit and supporting member, which edges are adjacent at least at one end with a first plane therebetween, is smaller than an included angle between the heat exchange unit and supporting member;

wherein the heat exchange unit has a bottom portion at a second plane and a top portion at a third plane, the second plane and the third plane being perpendicular to the first plane;

wherein the heat exchange unit defines a first area at the second plane and a second area at the third plane, the first area being smaller than the second area;

wherein the included angle between the two edges of the heat exchange unit and the included angle between the heat exchange unit and the supporting member span in a direction perpendicular to the first plane and extend between the second plane and the third plane.

20. The heat exchange apparatus as claimed in claim 19, wherein: the included angle between the two edges which are adjacent at least at one end is in the range of 0° to 15°.

21. The heat exchange apparatus as claimed in claim 19, wherein: the supporting member is a metal plate, and the minimum separation between two adjacent edges of the supporting member and heat exchange unit is in the range of 0-100 mm.

22. A heat source unit, the heat source unit also comprising, in cooperation with each other, a heat exchange apparatus, a blower, a water drainage plate in communication with a heat exchanger apparatus, and a machine room which houses cooling cycle constituent parts other than the heat exchange apparatus, wherein the heat exchange apparatus is a heat exchange apparatus as claimed in claim 1.

23. The heat exchange apparatus as claimed in claim 1, further comprising:

an inlet manifold and an outlet manifold with flat tubes therebetween;

a plurality of fins;

wherein the inlet manifold, the outlet manifold, the flat tubes and the plurality of fins are disposed in the heat exchanger module.

* * * * *